United States Patent [19]

Osterhout

[11] Patent Number: 4,466,283

[45] Date of Patent: Aug. 21, 1984

[54] DIVERS CONSOLE WITH KNIFE AND SHEATH

[76] Inventor: Ralph F. Osterhout, 340 Lombard St., San Francisco, Calif. 94133, now by change of name from Ralph Barr Shamlian

[21] Appl. No.: 401,364

[22] Filed: Jul. 23, 1982

[51] Int. Cl.[3] ..... G01F 23/14; B26F 3/00; B26F 11/00

[52] U.S. Cl. ..... 73/300; 7/164; 30/123; 73/431; 73/432 AD; 73/714

[58] Field of Search ..... 73/431, 300, 432 AD, 73/714; 7/119; 30/123

[56] References Cited

U.S. PATENT DOCUMENTS

| | | | |
|---|---|---|---|
| 1,115,780 | 11/1914 | Champlin | 7/119 |
| 3,861,417 | 1/1975 | Rowe | 73/431 |
| 4,077,257 | 3/1978 | Leemann | 73/300 |
| 4,178,681 | 12/1979 | Hanses | 30/151 |
| 4,197,747 | 4/1980 | Koehler | 73/431 |

*Primary Examiner*—S. Clement Swisher

*Attorney, Agent, or Firm*—Quaintance & Murphy

[57] ABSTRACT

A diver's combined gauge console having an integral mount for a knife and sheath. The gauges may include a tank pressure gauge and a depth gauge. The gauges may be slightly tilted toward one another for ease of reading. The depth gauge may be externally adjustable.

12 Claims, 8 Drawing Figures

DIVERS CONSOLE WITH KNIFE AND SHEATH

BACKGROUND OF THE INVENTION

This invention relates generally to underwater diving equipment and more particularly to an improved instrumentation console having a diver's knife mounted in assembly therewith.

The diver's console herein disclosed and claimed is primarily designed for use in association with an otherwise conventional scuba diving assembly, including a tank of compressed air and a regulator attached to the tank which provides breathable air at ambient pressure to the diver on demand. However, the invention is not to be deemed as being limited solely to the use just described.

Current, state-of-the-art scuba diving systems just described also include, for the sake of safety, a pressure gauge attached by a suitable hose to the regulator or tank; the pressure gauge provides the diver an indication of how much air remains in the tank during the course of a dive. Obviously, a low pressure tank reading indicates to the diver that he should return to the surface before the air supply is exhausted. Two other rather essential safety items that a scuba diver should carry are a depth gauge and diver's knife. The depth gauge is important because the depth of the dive and the time of the dive must be interrelated in order to either avoid stage decompression before returning to the surface or to determine how much decompression is required and at what depth prior to returning to the surface. The diver's knife is an important piece of safety equipment as it is used as a piercing and/or cutting tool, particularly in the event of diver entanglement in rope, netting, nylon line or fishing line, while underwater.

Previously, a diver's depth gauge was ordinarily worn about the wrist, although recently, diver's consoles or "combo boards" have been developed which encase the pressure gauge described above and provide additional mounts for insertion of the depth gauge and, perhaps, and underwater compass. Diver's knives have usually been mounted within a sheath which was strapped to a diver's upper or lower leg or upper or lower forearm. Lately, some divers have used the sheath straps to loosely attach the diver's knife and sheath to the portion of the hose between the pressure gauge and regulator or tank. However, secure attachment is impossible and the loss of this essential piece of safety equipment has not been uncommon.

There are other deficiencies in currently available diver's depth gauges and knives. Depth gauges currently available on the market are generally not adjustable in the field but must be sent to a specialist having suitable equipment for readjustment. Conventional diver's knives are made from several components, and breakage of one of the components is not uncommon. Additionally, diver's knives are usually retained in sheaths by means of a rubber ring or circle on the sheath for retaining the handle of the knife. These rubber rings are difficult to use, particularly under water, and are subject to deterioration and breakage. Loss of the knife is the usual result.

Other than the prior art as described above, there is little patent literature which is relevant to the herein disclosed and claimed invention. Conventional diver's consoles are disclosed in U.S. Pat. Nos. 3,693,446; 3,828,611; 3,831,449; 3,888,127; and 4,107,996. Unconventional knife sheaths are disclosed in U.S. Pat. Nos. 3,252,489 and 4,030,194, the former disclosing storage of a knife within an ax handle and the latter disclosing nesting of a smaller knife within the handle of a larger knife. These are a great number of patents disclosing various latching mechanisms associated with a sheath for retaining a knife within the sheath. U.S. Pat. No. 2,859,516 discloses a spring-loaded sheath latch which engages the handle of the knife upon insertion of the knife in the sheath. U.S. Pat. No. 675,118 shows a somewhat related, spring-loaded latch for retaining a knife within its sheath.

However, the prior art does not disclose a diver's console including a diver's knife and sheath mounted in structural assembly with the console, the console also including one or mare diver's gauges.

SUMMARY OF THE INVENTION

Therefore, it is a principal object of this invention to provide a diver's console which houses one or more diver's gauges and retains a diver's knife and sheath in structural assembly on the console.

It is an object of this invention to provide a diver's console within which may be mounted one or more diver's gauges, one of such gauges being a pressure gauge connected by a hose to a gas source, the console being mounted about the pressure gauge and a portion of the pressure hose.

It is another object of the present invention to provide a diver's console for mounting a pressure gauge, depth gauge and sheath for a diver's knife therein, the depth gauge including a readjustment wheel and the console being configured to provide access to the depth gauge readjustment wheel.

Still another object of the invention is to provide a diver's console for mounting one or more diver's gauges and the sheath of a diver's knife in structural assembly, the sheath including a spring-loaded latch engagable with he handle of a knife merely upon insertion of the knife into its sheath.

It is a further object of the invention to provide a diver's console for mounting one or more diver's gauges and a diver's knife and sheath in structural assembly, the diver's gauges being slightly tilted with respect to each other so that both gauges may be read virtually simultaneously, with but a single glance.

It is yet a further object of the invention to provide a diver's console for mounting one or more diver's gauges and a diver's knife and sheath in structural assembly, the console being in the form of a single, unitary injection molding of relatively flexible plastics material or the like.

Further novel features and other objects and advantages of this invention will become apparent from the following detailed description, discussion and the appended claims taken in conjunction with the accompanying drawings.

BRIEF DESCRIPTION OF THE DRAWINGS

A preferred structural embodiment of this invention is disclosed in the accompanying drawings in which.

DESCRIPTION OF THE PREFERRED EMBODIMENT

Figure 1:
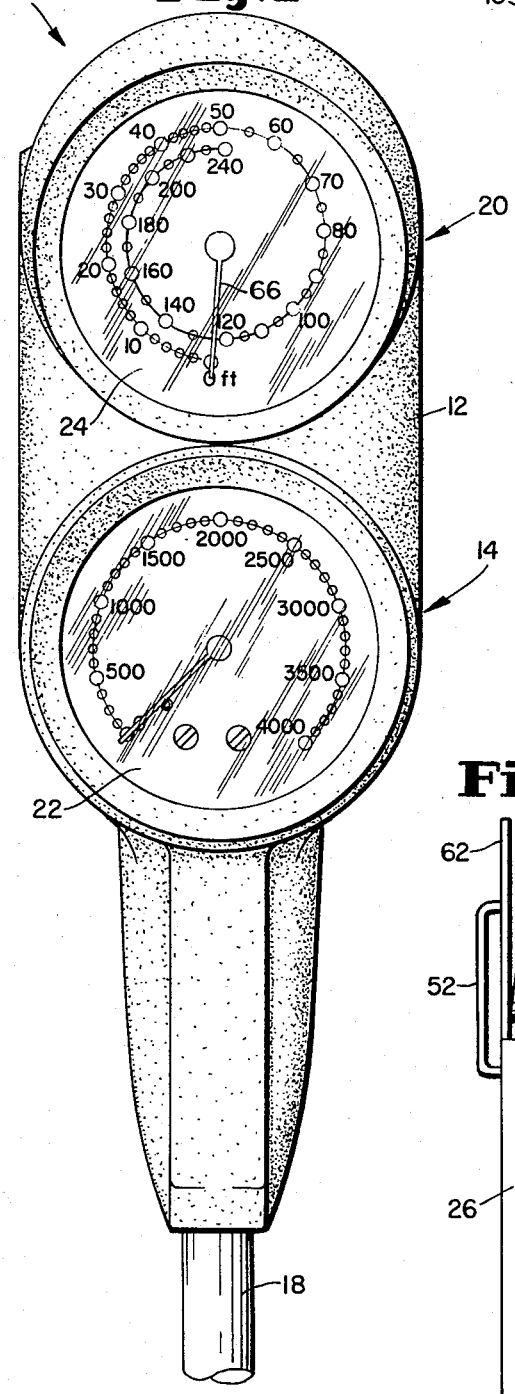
FIG. 1 is a top, plan view of the invention drawn to a 1—1 or full size scale.
Figure 2:
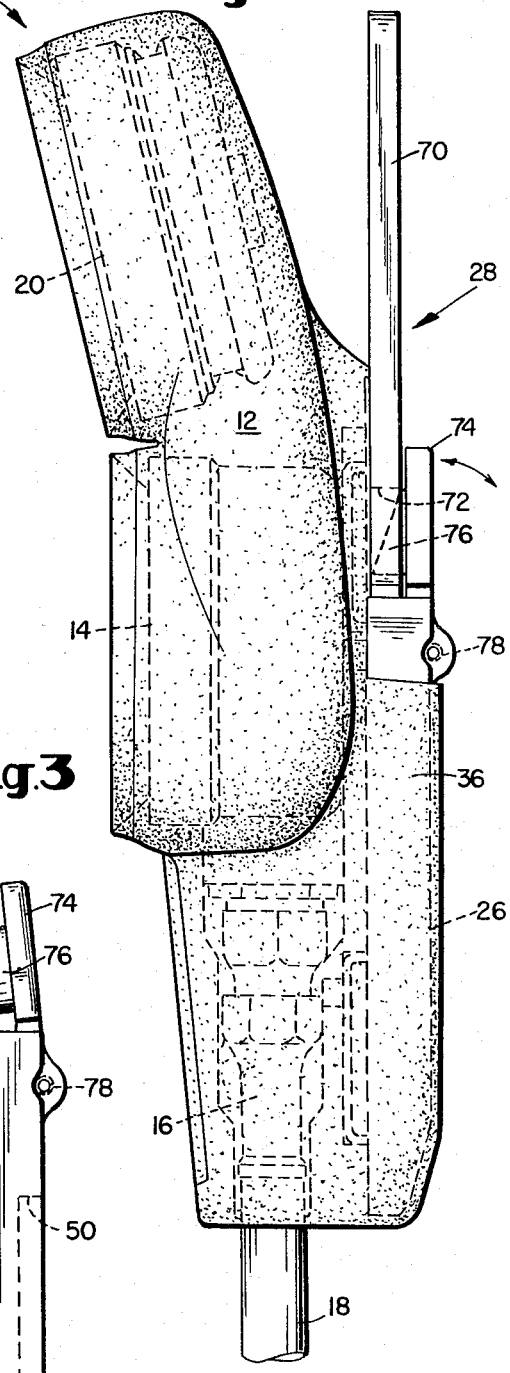
FIG. 2 is a side, elevation view of the invention as shown in FIG. 1.

Referring now to the drawings by reference character, and in particular to FIGS. 1 and 2 thereof, the diver's console of this invention is generally indicated by the reference character 10. In the preferred embodiment of the invention, console 10 is in the form of a casing 12 within which are assembled a pressure gauge 14 and adjacent end portion 16 of a pressure hose 18, a depth gauge 20 and, on a side of casing 12 opposite the dial faces 22 and 24 of pressure gauge 14 and depth gauge 20, respectively, a sheath 26 within which is secured a diver's knife 28.

Figure 7:
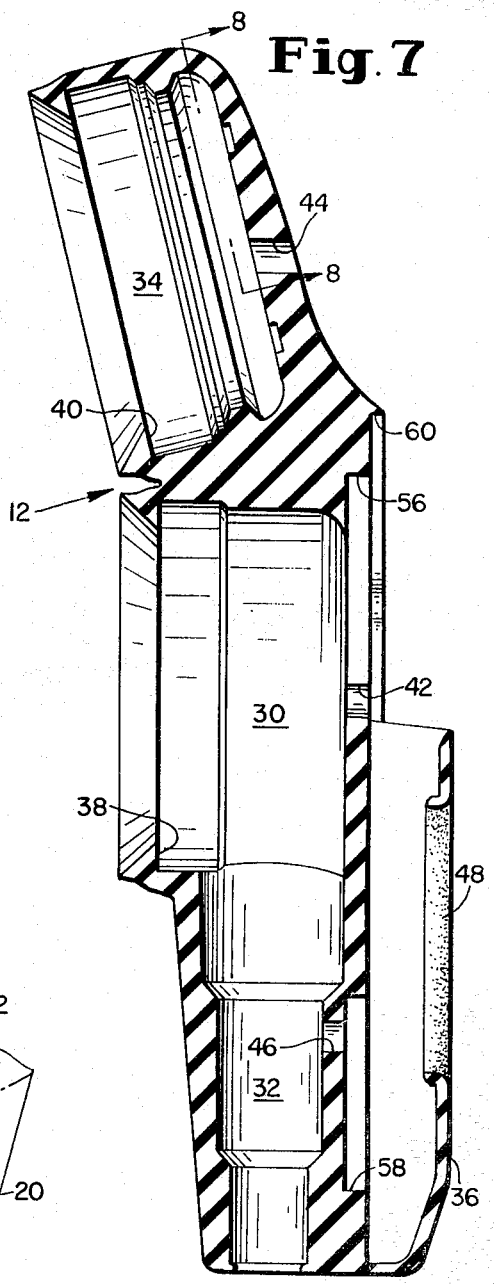
FIG. 7 is an elevation, section view of the casing forming the diver's console.
Figure 8:
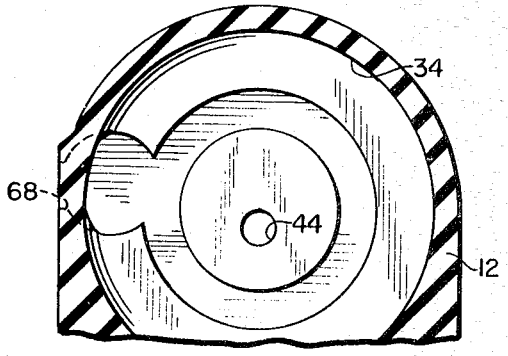
FIG. 8 is a detail section view taken along Lines 8—8 of FIG. 7.

At its other end, pressure hose 18 is connected to either the first stage of a scuba regulator or a tank (not shown) which provides, under pressure, a source of breathable gas (usually, but not necessarily, air) for the diver. Of course, the tank and regulator described form no part of the instant invention per se. As can be seen more clearly from FIG. 2, casing 12 may be in the form of a single, unitary injection molding of relatively flexible rubber, plastics or other material. The material is relatively flexible in order to facilitate assembly of pressure gauge 14, depth gauge 20, and knife sheath 26 therewithin. The internal structure of casing 12 is best seen in FIG. 7. A first hollow chamber 30 is molded therewithin having a lower extension 32, the internal dimensions of chamber 30 and extension 32 being approximately the same as the external dimensions of pressure gauge 14 and pressure hose end 16, respectively. Similarly, casing 12 includes a second chamber 34 which is interiorly dimensioned to match, approximately, the external dimensions of depth gauge 20. Also, the rear face of casing 12 is provided with an integral pocket 36 which receives knife sheath 26. Also, as shown in FIG. 7, chamber 30 includes a peripheral lip 38 for locking pressure gauge 14 therewithin and, similarly, chamber 34 has a peripheral lip 38 for retaining depth gauge 20 therewithin. Chambers 30 and 34 are further provided with pressure relief bores 42 and 44, respectively, which prevent a pressure lock from occurring within the chambers when console 10 is subjected to pressure, during descent in a dive, or relief of pressure, on surfacing during or after a dive. A similar pressure relief bore 46 is provided for casing extension 32.

Assembly of pressure gauge 14 and depth gauge 20 within casing 12 is rather easily accomplished. Hose 18 of pressure gauge 14 is inserted through extension 32 whereafter the relatively flexible walls of casing 12 are simply folded over pressure gauge 14 with peripheral retaining lip 38 being smoothed about the periphery of the pressure gauge 14. Depth gauge 20 is inserted within chamber 34 and retaining lip 40 thereof is then smoothed about the periphery of depth gauge 20. Once assembled as aforesaid, it is rather difficult but not impossible, to remove the gauges, as for servicing.

Figure 3:
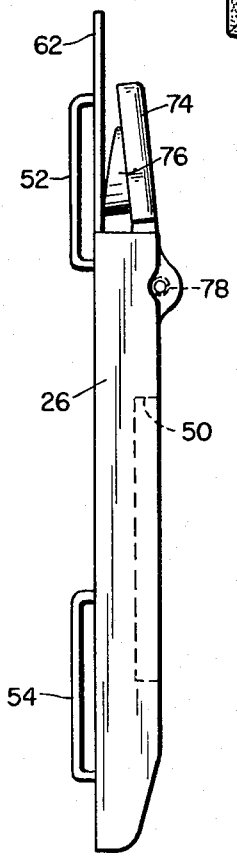
FIG. 3 is a side, elevation view of the sheath for a diver's knife, as shown in FIG. 2, but removed from the diver's console.

Referring now to FIGS. 2, 3, 4 and 7, knife sheath 26 is retained within pocket 36, first by a locking lip 48 which is generally rectangular in shape (FIG. 4) and interlocks with a generally mating recess 50 (FIG. 3) formed through an outer face of sheath 26. Additionally, as shown in FIG. 3, the rear of sheath 26 is provided with a pair of strap loops or guides 52, 54 which interfit within recesses 56, 58, respectively, formed within the rear face of casing 12 (FIG. 7). A secondary recess 60, above recess 56, is also formed within the rear face of casing 12 to accommodate an upper extension 62 (FIG. 3) of sheath 26. Strap loops or guides 52, 54 are provided because the knife and sheath of this invention may be marketed separately; straps are provided (not shown) to secure the knife and sheath assembly to the arm or leg of a diver.

Referring now to FIGS. 4, 5, 6 and 8, depth gauge 20 is provided with an adjustment wheel 64 which is employed to rezero or adjust depth gauge 20, periodically. For example, a diver might descend to a known depth, such as the bottom of a swimming pool which is ten feet deep, whereupon wheel 64 is rotated until dial pointer 66 (FIG. 1) is aligned with the ten-foot marking therein shown. Access to readjustment wheel 64 is provided by a slot 68 formed within casing 12 adjacent wheel 64, but the wheel 64 is located slightly within the casing (FIG. 4) so that the wheel is not rotated by accident.

Figure 4:
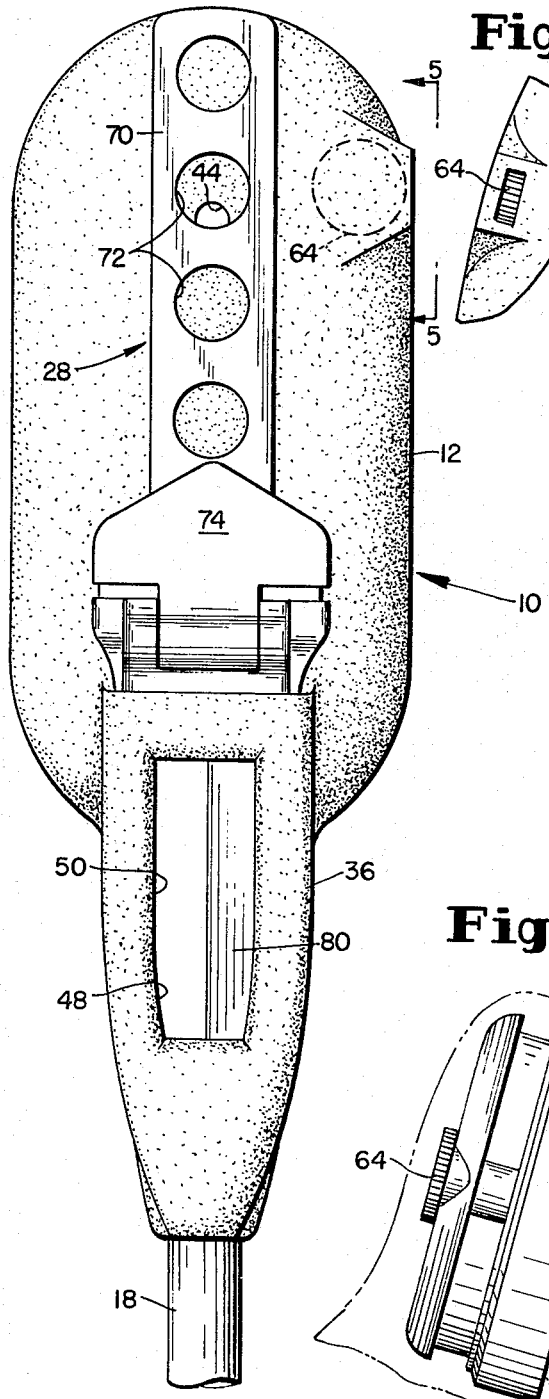
FIG. 4 is a rear, plan view of the invention as shown in FIG. 1.
Figure 5:
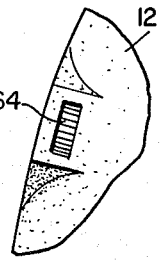
FIG. 5 is a fragmentary detail view taken along Lines 5—5 of FIG. 4.
Figure 6:
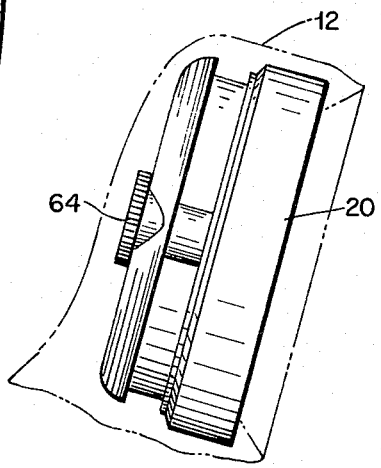
FIG. 6 is a fragmentary, elevation view showing the depth gauge of the invention and a portion of the casing forming the console in phantom lines thereabout.

Turning now to FIGS. 2 and 4, diver's knife 28 is of one-piece construction, the handle 70 of which includes a series of bores 72. Sheath 26 includes a latch 74 having a rear projection 76 dimensioned to interfit within and engage a hole 72 in knife handle 70. Latch 74 is coil spring loaded at 78 to thus be pivotally forced against handle 70. Thus, to remove knife 28 from its sheath 26, it is necessary to pivot latch 74 outwardly so as to disengage latch 74 from the hole 72 and thus remove the knife from its sheath. However, reinsertion of the knife within this sheath is rather easily accomplished. The rear face of lug 76 is sloped so that when the blade 80 of knife 28 strikes lug 76, latch 74 is thus automatically pivoted outwardly whereupon completion of reinsertion of the knife within the sheath is completed, with lug 76 then reengaging a hole 72 due to the return action of spring 78.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. For mounting a knife and sheath in structural assembly with one or more diver'gauges, console means comprising casing means for mounting one or more of said gauges whereby said one or more gauges may be read by the diver while underwater; and means associated with said casing means for mounting sheath means, for a knife or the like, in structural, relatively rigid assembly with said console means, one of said gauges being a source of compressed breathing gas pressure indication gauge having a hose interconnecting the pressure gauge and the source, said casing means enclosing a portion of the hose adjacent the gauge and encasing the pressure gauge except for the dial face thereof.

2. The console means as claimed in claim 1 wherein said casing means include means for encasing a diver's depth gauge therein, except for the dial face thereof.

3. The console means as claimed in claim 2 wherein the depth gauge includes an exposed readjustment wheel, said means for encasing the depth gauge including slot means formed adjacent the readjustment wheel for providing access to the readjustment wheel.

4. The console means as claimed in claim 1 wherein said means associated with said casing means for mounting sheath means include a sheath receptacle interlocking a sheath to the console means.

5. The console means as claimed in claim 4 wherein said sheath receptacle is located on a side of said console means opposite the mounting of the one or more gauges.

6. The console means as claimed in claim 4 wherein said sheath receptacle includes a knife sheath having spring-loaded engaging means cooperating with a knife handle for removably locking a knife therein.

7. The console means as claimed in claim 6 further comprising a knife having means formed through a handle thereof interengageable with said spring-loaded engaging means.

8. The console means as claimed in claim 7 wherein said knife is of unitary, one-piece construction.

9. The console means as claimed in claims 6 or 7 wherein said spring-loaded engaging means is arranged and configured so that it is manually moved to a non-engaging condition whereby a knife may be removed from the sheath, but is automatically engageable with the knife upon simple insertion of the knife into the sheath.

10. The console means as claimed in claim 1 wherein said casing means is arranged to mount two gauges therein, the dial faces therein being located in slightly tilted fashion with respect to each other, for ease of reading of the gauges.

11. The console means as claimed in claim 1 further comprising, in combination, a diver's depth gauge, a source of compressed breathing gas pressure indication gauge, a diver's knife and a sheath for said diver's knife.

12. The console means as claimed in claim 1 wherein said casing means comprise a single, unitary injection molding of relatively flexible plastics material or the like.

* * * * *